US006007189A

United States Patent [19]

Yano et al.

[11] Patent Number: 6,007,189

[45] Date of Patent: Dec. 28, 1999

[54] PIEZOELECTRIC TYPE INK-JET PRINTING HEAD HAVING A PRESSURE CHAMBER PLATE WHICH IS LESS FLEXIBLE THAN PIEZOELECTRIC ELEMENTS

[75] Inventors: Akio Yano; Akihiko Miyaki; Masahiro Ono, all of Inagi, Japan

[73] Assignees: Fujitsu Isotec Limited, Inagi; Fujitsu Limited, Kawasaki, both of Japan

[21] Appl. No.: 08/517,209

[22] Filed: Aug. 21, 1995

[30] Foreign Application Priority Data

Jan. 18, 1995 [JP] Japan ..... 7-005883

[51] Int. Cl.[6] ..... B41J 2/045

[52] U.S. Cl. ..... 347/71

[58] Field of Search ..... 347/68, 71, 72, 347/40, 48

[56] References Cited

U.S. PATENT DOCUMENTS

| | | | |
|---|---|---|---|
| 4,987,665 | 1/1991 | Aoki | 28/218 |
| 4,999,819 | 3/1991 | Newnham et al. | 310/334 X |
| 5,045,744 | 9/1991 | Ando et al. | 310/320 |
| 5,126,615 | 6/1992 | Takeuchi et al. | 310/330 |
| 5,359,354 | 10/1994 | Hiraishi et al. | 347/69 |
| 5,363,131 | 11/1994 | Momose et al. | 347/68 X |
| 5,376,857 | 12/1994 | Takeuchi et al. | 347/72 X |
| 5,434,608 | 7/1995 | Sugahara et al. | 347/71 |
| 5,535,494 | 7/1996 | Plesinger et al. | 29/25.35 |
| 5,543,009 | 8/1996 | Hayes | 156/268 |
| 5,548,314 | 8/1996 | Okazawa et al. | 347/71 |

FOREIGN PATENT DOCUMENTS

| | | |
|---|---|---|
| 24 44 517 | 4/1976 | Germany . |
| 3-272855 | 12/1991 | Japan . |
| 4-64448 | 2/1992 | Japan . |
| 4-341851 | 11/1992 | Japan . |
| 4-341853 | 11/1992 | Japan . |
| 6-188475 | 7/1994 | Japan . |

OTHER PUBLICATIONS

Relva C. Buchanan, Ceramic Materials for Electronics Processing, Properties and Applications, M. Dekker Inc, NY, TK871.15.C4C47, p. 1, 1991.

Lewis, R.J., Sr., Hawley's Condensed Chemical Dictionary, V.N. Reinhold Co., NY, p. 387,917, ISBN 0–442–01131–8, 1993.

JP 4–359807, May 11, 1993, Patent Abstracts of Japan.

*Primary Examiner*—John Barlow
*Assistant Examiner*—C. Dickens
*Attorney, Agent, or Firm*—Armstrong, Westerman, Hattori, McLeland & Naughton

[57] ABSTRACT

A piezoelectric type ink-jet printing head including a pressure chamber plate having a plurality of pressure chambers and a plurality of ink supply ports for supplying ink into the respective pressure chambers, a nozzle plate having a plurality of nozzles and a piezoelectric element having a surface, at least parts thereof defining a plurality of displacement portion. The nozzle plate is attached to one of the surfaces of the pressure chamber plate, in such a manner that the respective nozzles are connected to the respective pressure chambers. The other surface of the pressure chamber plate is attached to the piezoelectric element, in such a manner that each of the displacement portions of the piezoelectric element defines at least one of walls of each of the pressure chambers.

41 Claims, 10 Drawing Sheets

PIEZOELECTRIC TYPE INK-JET PRINTING HEAD HAVING A PRESSURE CHAMBER PLATE WHICH IS LESS FLEXIBLE THAN PIEZOELECTRIC ELEMENTS

BACKGROUND OF THE INVENTION

1. Field of the Invention

This invention relates to a piezoelectric type ink-jet printing head which can advantageously be used in an office automation machine such as a copying machine, a facsimile, a computer, a wordprocessor, a combination of these machines, or the like.

2. Description of the Related Art

An ink-jet printer is a type of printer in which liquid ink is injected through the air as small drop, a liquid column or a mist and onto a recording paper to print thereon letters, graphics, images or the like. In general, there are two types of printing heads used in such an ink-jet printer, i.e., a bubble type printing head in which bubbles are generated in the ink pressure chamber by a heater and the ink is injected by the bubble pressure, and an oscillation plate type printing head in which a pressure plate is provided at the bottom of the pressure chamber and the pressure plate is pushed by a piezoelectric actuator to inject the ink from the nozzle.

These two types of ink-jet printer heads have the following problems. In the bubble type printing head, the efficiency of the head substantially depends on the nature or the characteristics of the ink and, therefore, there are limitations in printing speed and quality. Therefore, it would be relatively difficult to satisfy the recent requirements of speed and image quality in printers using a bubble type printing head. In the oscillation plate type printing head, a pressure chamber and a nozzle are located on the upper side of a pressure plate and a piezoelectric actuator is located on the lower side of the pressure plate, so that a pressure chamber is defined between the pressure plate and the piezoelectric actuator. Therefore, the printing head is relatively complicated in construction and becomes rather expensive.

To solve the above-mentioned problems in the oscillation plate type printing head, in another type of known ink-jet printing head a part of the pressure chamber is constituted by an electrode of the piezoelectric element by itself, so that the pressure chamber is compressed by the displacement of the piezoelectric element to inject the ink in the pressure chamber through the nozzles. In this respect, the following types of ink-jet printers have been proposed in the prior art.

Japanese Unexamined Patent Publication (Kokai) No. 4-64448 discloses an ink-jet recording apparatus in which a piezoelectric element is provided with several slits to make respective actuators in the projected portions divided by these slits and parallel passages are formed in conformity with the respective projected portions, so that a displacement of the actuator in a direction perpendicular to the parallel passages can be obtained. Thus, ink in a common chamber connected to one end of each parallel passage can be injected from nozzles provided at the other end of each end parallel passage. The piezoelectric element comprises non-active areas where there are no electrodes and the thickness thereof is not changed and active areas where there are electrodes and the thickness thereof is changed. These active areas are located so as to define at least one wall of the parallel passages. The slits are filled with any filler.

However, in this ink-jet recording apparatus, since the individual actuators are divided by means of a plurality of slits in the piezoelectric element, the construction thereof is rather complicated and therefore expensive.

Japanese Unexamined Patent Publication (Kokai) No. 3-272855 discloses an ink-jet printing head comprising a base substrate, a common electrode formed thereon a piezoelectric material formed on the substrate, and a local electrodes formed on the piezoelectric material. A voltage is applied across these electrodes at the resonant frequency, in the thickness direction, of the piezoelectric material to effectively compress the ink. The pressure chamber is not divided but is common to all of the nozzles.

In this ink-jet printing head, since the pressure chamber is not divided but is commonly used for the plurality of nozzles, the structure of the pressure chamber can be simplified. On the other hand, it is difficult to keep constant the amount of ink injected from the individual nozzles and, therefore, the printing quality is reduced. Also, the direction of the ink-jet is restricted to the direction of displacement of the piezoelectric material and, therefore, it is difficult to constitute an "edge shoot" type printing head in which ink is injected in a direction perpendicular to the displacement of the piezoelectric material.

Japanese Unexamined Patent Publication (Kokai) No. 6-188475 discloses a laminated piezoelectric element in which piezoelectric material and electrodes (common and local electrodes) are alternately laminated, so that an electric field can be selectively generated in the laminated direction. A voltage is applied to the laminated piezoelectric element to exert a pressure in the pressure chamber to inject the ink from the nozzle.

However, when a pressure is exerted in the pressure chamber by the laminated piezoelectric element, since the piezoelectric element is buried in the recess of the base substrate and the walls of the pressure chamber (at least a part thereof) are not defined by the piezoelectric element, pressure is indirectly exerted to the ink in the pressure chamber by means of a membrane. Therefore, a large pressure cannot be obtained.

Japanese Unexamined Patent Publication (Kokai) No. 4-341853 discloses a piezoelectric-type ink-jet printer head comprising a laminated piezoelectric element having a plurality of divided inner electrodes and local displacement portions which are locally displaced when a voltage is applied to the electrodes. The thickness of one layer of piezoelectric material of the laminated piezoelectric element is 40 to 150 $\mu$m.

SUMMARY OF THE INVENTION

An object of the present invention is to provide a piezoelectric-type ink-jet printing head in which the amount of ink injected by the respective nozzles can be kept constant, the construction thereof can be simplified, and the head is not expensive.

According to the present invention, there is provided a piezoelectric type ink-jet printing head comprising: a pressure chamber plate defining a pressure chamber; means for supplying ink into said pressure chamber; means for connecting said pressure chamber to a nozzle means; a piezoelectric element having a surface, at least a part thereof defining a displacement portion; said pressure chamber plate being attached, to said surface of the piezoelectric element, in such a manner that said displacement portion of the piezoelectric element defines at least one of the walls of said pressure chamber.

When an electric voltage is applied to the piezoelectric element, the displacement portion of the piezoelectric element displaces to compress the ink in the pressure chamber and ink in the pressure chamber is ejected from the nozzle.

It is preferable that said pressure chamber plate has a plurality of said pressure chambers, that said piezoelectric element comprises a common electrode, a plurality of local electrodes and a piezoelectric material arranged between said common electrode and said local electrodes, and that areas where said local electrodes cross said common electrode define a plurality of said displacement portions corresponding to said respective pressure chambers.

It is also preferable that said piezoelectric element comprises a laminated structure made of a plurality of layers, in which said common electrode and a plurality of local electrodes are alternately laminated with the piezoelectric material therebetween, and said local electrodes of the respective layers, which are arranged to correspond to each of said respective pressure chambers, are electrically connected to each other through said plurality of layers.

Thus, the displacement portions of the piezoelectric element are defined at the areas where said local electrodes cross said common electrodes and these displacement portions define walls of the respective pressure chambers.

It is also preferable that said piezoelectric element comprises a piezoelectric material, a common electrode buried in said piezoelectric material, a plurality of local electrodes arranged on one of the surfaces of said piezoelectric material so as to be spaced from said common electrode and a metal plate attached to the other surface of said piezoelectric material.

The other surface of the piezoelectric material, to which a metal plate is attached, is not deformed. Thus, the displacement portion formed on one of the surfaces of the piezoelectric element more effectively displaces and acts on the pressure chamber when an electric voltage is applied to the piezoelectric element.

DESCRIPTION OF THE PREFERRED EMBODIMENTS

Figure 1:
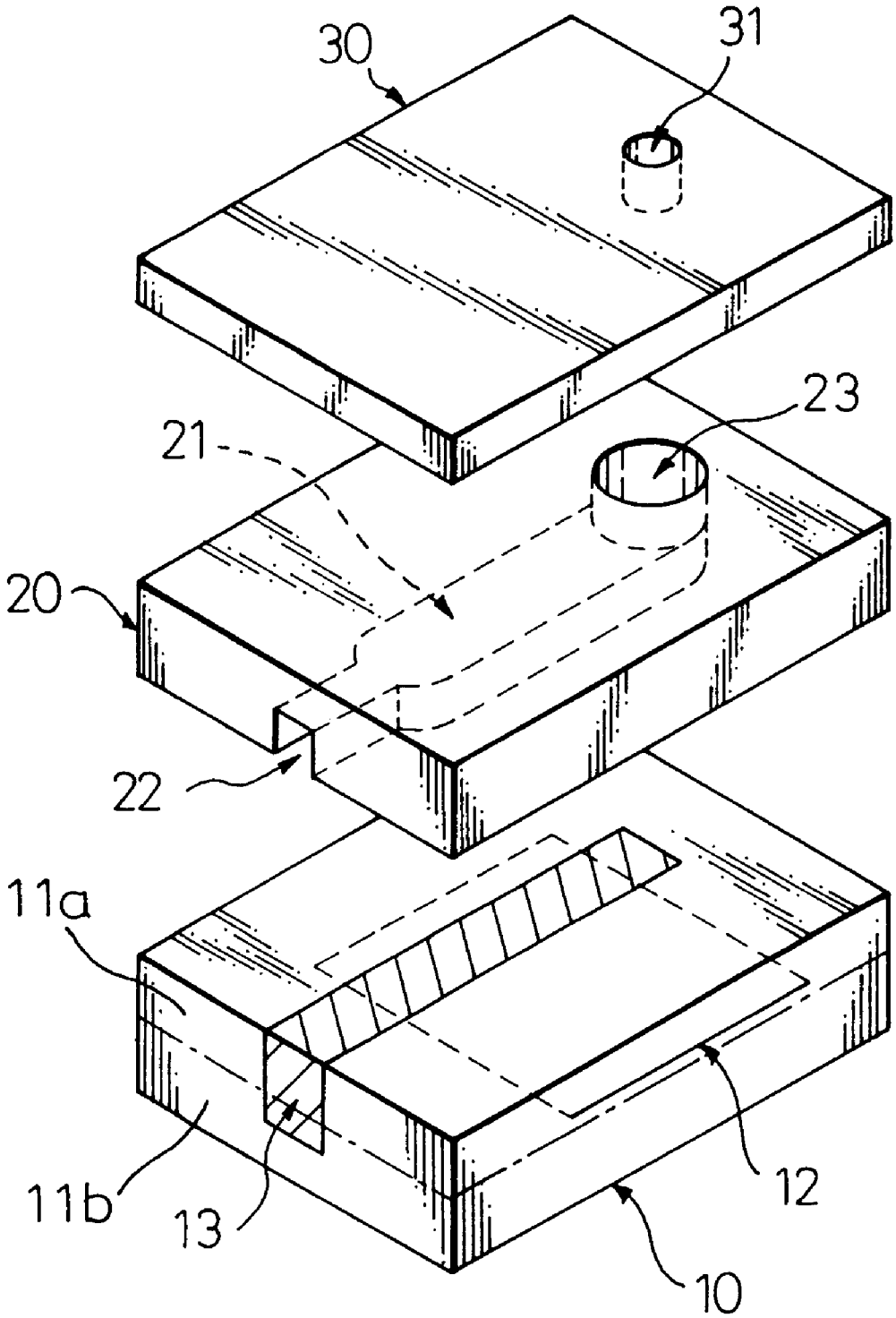
FIG. 1 is a schematic perspective view of an ink-jet printing head according to the present invention.
Figure 2:
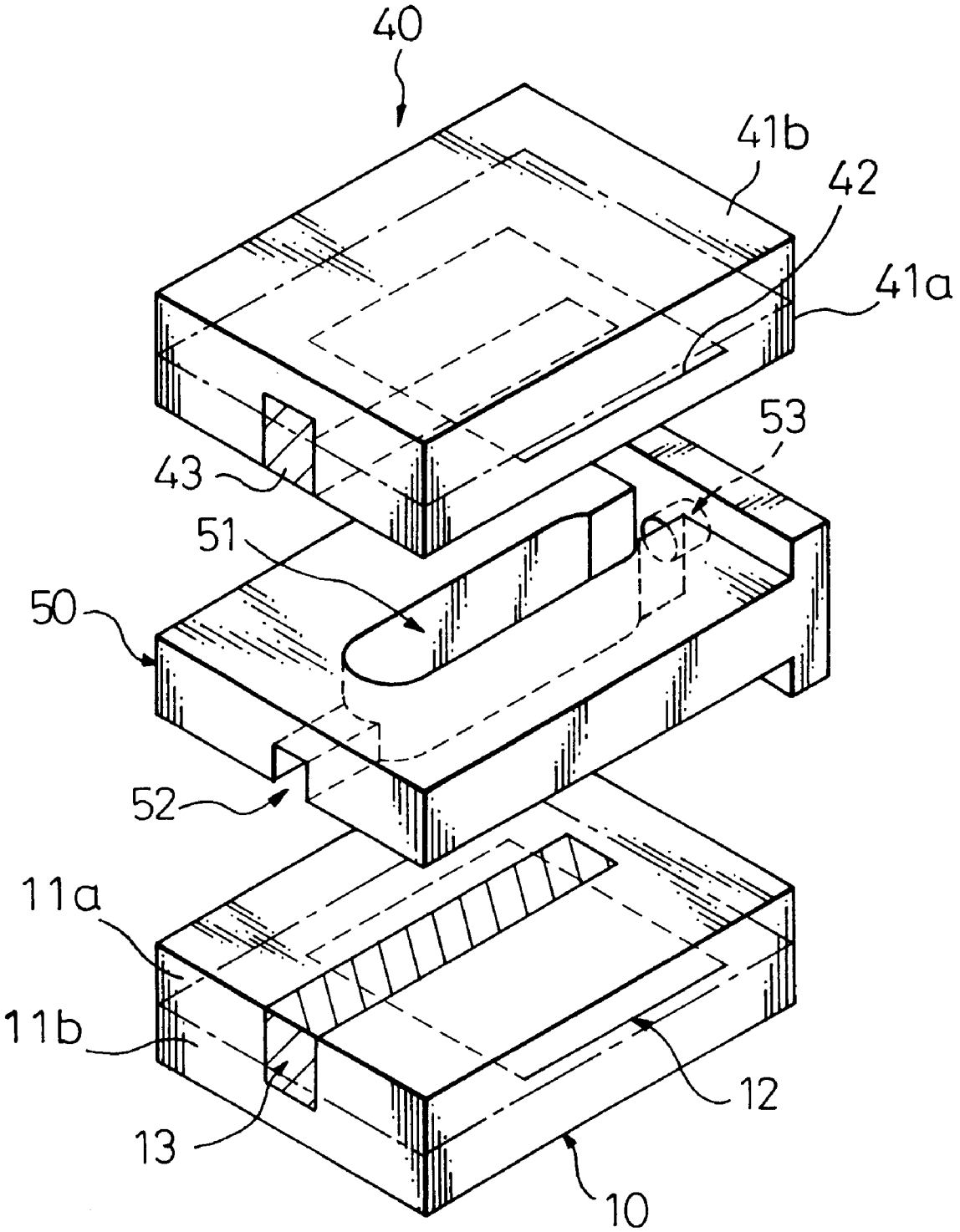
FIG. 2 is a schematic perspective view of an ink-jet printing head having two piezoelectric elements according to this invention.

Referring now to the drawings, wherein FIGS. 1 and 2 illustrate the principle of a piezoelectric type ink-jet printing head according to this invention. In FIG. 1, the printing head comprises a piezoelectric element 10, a pressure chamber plate 20 and a nozzle plate 30. The piezoelectric element 10 comprises an insulated board 11*b* made of, for example, ceramic, a plane common electrode 12 having a relatively large area and formed on the upper surface of the insulated board 11*b*, a piezoelectric layer 11*a*, made of a material such as PNN piezoelectric material, laminated on the common electrode 12, and a strip-like local electrode 13 arranged in parallel to and spaced from the common electrode 12.

More particularly, before a thick-film green sheet is fired to make the above-mentioned insulated board 11*b*, an electrode layer (which is to be the above-mentioned common electrode 12) in the form of a conductive paste, is laminated by screen printing or the like, and a paste-like piezoelectric material (which is to be the above-mentioned piezoelectric layer 11*a*) is also laminated thereon by screen printing or the like in the same manner as above. A conductive paste (which is to be the above-mentioned local electrode) is then laminated thereon in the same manner as above, and then the laminated body is fired. A sheet-like piezoelectric film can also be laminated as the material of the piezoelectric layer 11*a* in addition to the conductive paste as mentioned above.

The pressure chamber plate 20 comprises a pressure chamber 21 opened at one of the surfaces of this pressure chamber plate 20, an ink supply port 22 provided at one end of the pressure chamber plate 20 for introducing ink into this pressure chamber 20, and an ink outlet port 23 opened at the opposite surface of the pressure chamber plate 20 for ejecting ink from this pressure chamber 20.

The piezoelectric element 10 and the pressure chamber plate 20 are joined to each other in such a manner that a part of the piezoelectric material 11*a* (i.e., a displacement portion), where the common electrode 12 of the piezoelectric element 10 crosses the local electrode 13 thereof, corresponds to the pressure chamber 21. Also, the pressure chamber plate 20 and the nozzle plate 30 are joined to each other in such a manner that the ink outlet port 23 of the pressure chamber plate 20 corresponds to a nozzle 31 of the nozzle plate 30. Ink is filled in the pressure chamber 21 through the ink supply port 22, so that no air bubbles are included therein.

When an electric voltage is applied between the common and local electrodes 12 and 13, only the displacement portion, where the common electrode 12 crosses the local electrode 13 is displaced, as will be described later, so that a pressure is exerted on the ink in the pressure chamber 21 and the ink is injected through the ink outlet port 23 from the nozzle 31.

In FIG. 2, the printing head comprises two piezoelectric elements 10 and 40 and a pressure chamber plate 50 having a nozzle 53. In the same manner as the piezoelectric element 10, the piezoelectric element 40 comprises an insulated board 41*b* made of ceramic or the like, a common electrode 42, a piezoelectric layer 41*a* and a local electrode 43 laminated on the insulated board 41*b*. The piezoelectric elements 10 and 40 are arranged on each side of the pressure chamber plate 50. Thus, the pressure chamber 51 of the pressure chamber plate 50 is opened at the respective surfaces thereof. The ink supply port 52 is provided at one end of the pressure chamber plate 50 and the nozzle 53 is provided at the other end thereof.

The two piezoelectric elements 10 and 40 and the pressure chamber plate 50 are joined together in such a manner that the portions, i.e., the displacement portions, where the common electrodes 12 and 42 of the piezoelectric elements 10 and 40 cross the local electrodes 13 and 43, respectively, correspond to the respective surfaces of the pressure chamber 51. Ink is filled in the pressure chamber 51, without air bubbles, through the ink supply port 52.

When an electric voltage is applied between the common electrodes 12 and 42 and local electrodes 13 and 43, respectively, only the displacement portions, where the common electrodes 12 and 42 of the piezoelectric elements 10 and 40 cross the local electrodes 13 and 43, are displaced, as will be described later, so that a pressure is exerted on the ink in the pressure chamber 51 and the ink is ejected from the nozzle 53 in a direction perpendicular to the displacement of the piezoelectric elements 10 and 40.

Figure 3:
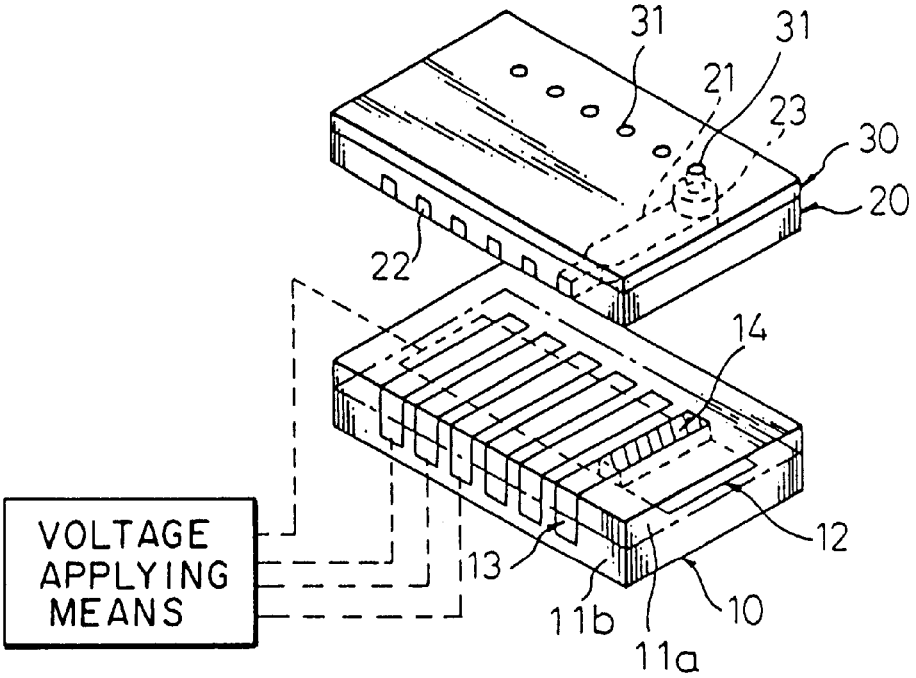
FIG. 3 is a perspective view of an embodiment of an ink-jet printing head.

FIG. 3 shows an embodiment of this invention corresponding to that of FIG. 1. Corresponding or similar elements are indicated by the same reference numerals. In FIG. 3, the printing head comprises a piezoelectric element 10, a pressure chamber plate 20 and a nozzle plate 30. The piezoelectric element 10 comprises, as described above, an insulated board 11*b* made of, for example, ceramic, a plane common electrode 12 having a relatively large area and formed on the upper surface of the insulated board 11*b*, a piezoelectric layer 11*a* laminated on the common electrode 12, and a plurality of strip-like local electrodes 13 arranged in parallel to each other and spaced from the common electrode 12.

The pressure chamber plate 20 has a plurality of pressure chambers 21 each opened at one of the surfaces of the pressure chamber plate 20, a plurality of ink supply ports 22 provided at one end of each pressure chamber plate 20 for introducing ink into the respective pressure chambers 21, and a plurality of ink outlet ports 23 opened at the other surface of the pressure chamber plate 20 for introducing the ink from the respective pressure chambers 21. The nozzle plate 30 has a plurality of nozzles 31 for the respective ink supply ports 23 for ejecting the ink from the respective ink pressure chambers 21.

The piezoelectric element 10 and the pressure chamber plate 20 are joined to each other in such a manner that the portions of the piezoelectric material 11*a,* where the common electrode 12 crosses the respective local electrodes 13, correspond to the respective pressure chambers 21. Also, the pressure chamber plate 20 and the nozzle plate 30 are joined to each other in such a manner that the respective ink outlet ports 23 of the pressure chamber plate 20 correspond to the respective nozzles 31 of the nozzle plate 30. Ink is filled in the respective pressure chambers 21 through the respective ink supply ports 22 so that no bubbles are included in the ink.

When an electric voltage is applied between the common electrodes 12 and a particular local electrode 13, only the displacement portion of the piezoelectric element 10 where the common electrode 12 crosses the particular local electrode 13 is displaced, so that a pressure is exerted to the ink in the particular pressure chamber 21 and the ink is ejected from the nozzle 31 through the ink outlet port 23.

Figure 4:
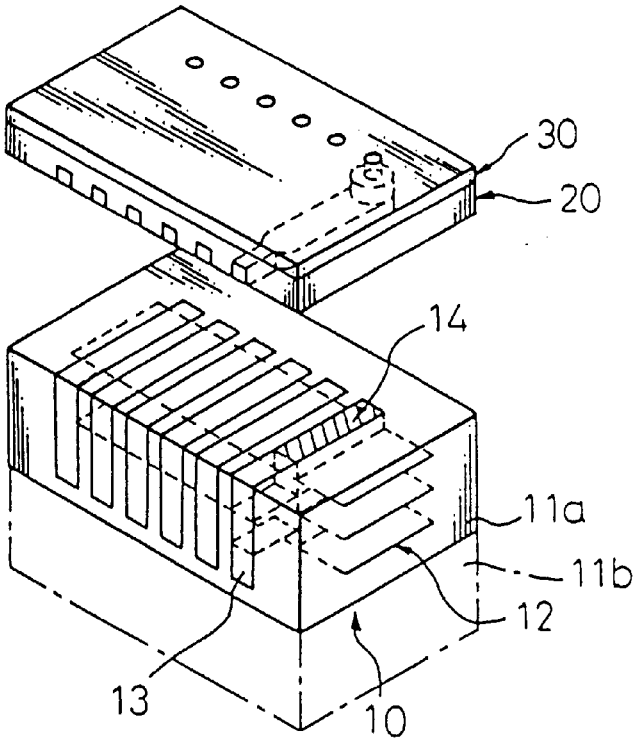
FIG. 4 is a perspective view of another embodiment of an ink-jet printing head.

FIG. 4 shows an embodiment which is similar to the embodiment shown in FIG. 3, except that the piezoelectric element 10 is a multilayer type. The piezoelectric element 10 in this embodiment comprises an insulated board 11*b* made of, for example, ceramic. On the upper surface of the insulated board 11*b*, a plane common electrode 12 having a relatively large area, a piezoelectric layer 11*a* and a local electrode 13 are layered. On the local electrode 13, a piezoelectric layer 11*a,* a common electrode 12 and a local electrode 13 are further layered in turn several times to make a multilayer laminated structure, which is then integrally fired. Thus, a plurality of common electrodes 12 are arranged and spaced by a certain distance in the thickness direction of the piezoelectric elements 10 and a plurality of local electrodes 13 are spaced in parallel to from each other by a certain distance so as to be inserted between the adjacent common electrodes 12.

Ink is filled in the respective pressure chambers 21 through the respective ink supply ports 22 so that no bubbles are included in the ink. When an electric voltage is applied between the common electrodes 12 and particular local electrode 13, only the displacement portion of the piezoelectric element 10 where the common electrode 12 crosses the particular local electrode 13 is displaced, so that a pressure is exerted to the ink in the particular pressure chamber 21 and the ink is ejected from the nozzle 31 through the ink outlet port 23. In this case the pressure exerted in the pressure chamber 21 is an accumulated pressure by the displacement of a plurality of layers.

Figure 5:
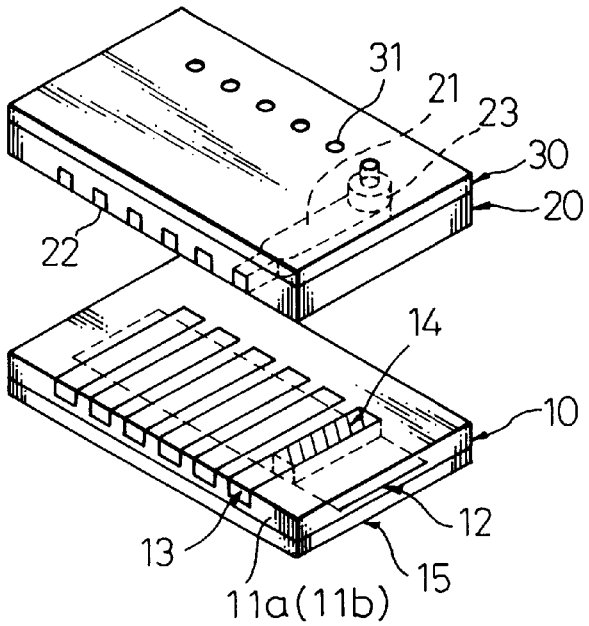
FIG. 5 is a perspective view of still another embodiment of an ink-jet printing head.

FIG. 5 shows a modification to that of generated FIG. 3. The piezoelectric element 10 comprises a laminated structure of an insulated board 11*b*, a common electrode 12, a piezoelectric layer 11*a* and a plurality of local electrodes 13 (the insulated board 11*b* and the piezoelectric layer 11*a* are integrally illustrated). The local electrodes 13 are arranged on one of the sides of the piezoelectric layer 11*a* facing the pressure chamber plate 13 and a metal plate 15 is attached to the other side thereof. The other structures and functions are the same as those of the embodiment of FIG. 3. In this embodiment, when an electric voltage is applied between the common electrodes 12 and a particular local electrode 13, only the displacing portion 14 of the piezoelectric layer 11*a* where the common electrode 12 crosses the particular local electrode 13 is displaced, so that a pressure is exerted on the ink in the particular pressure chamber 21 and the ink is ejected from the nozzle 31 through the ink outlet port 23.

In this embodiment, since the metal plate 15 is attached to the lower surface of the piezoelectric element 10 opposite to the surface on which the local electrodes 13 are formed, the displacement of the insulated substrate 11*b* is strongly restricted when the piezoelectric layer 11*a* is displaced, so that the displacement of the piezoelectric layer 11*a* is reduced at the side of the metal plate 15 and, on the contrary, the displacement of the piezoelectric layer 11*a* at the side of the pressure chamber is increased, so that a still larger pressure is exerted on the ink in the particular pressure chamber 21.

Figure 6:
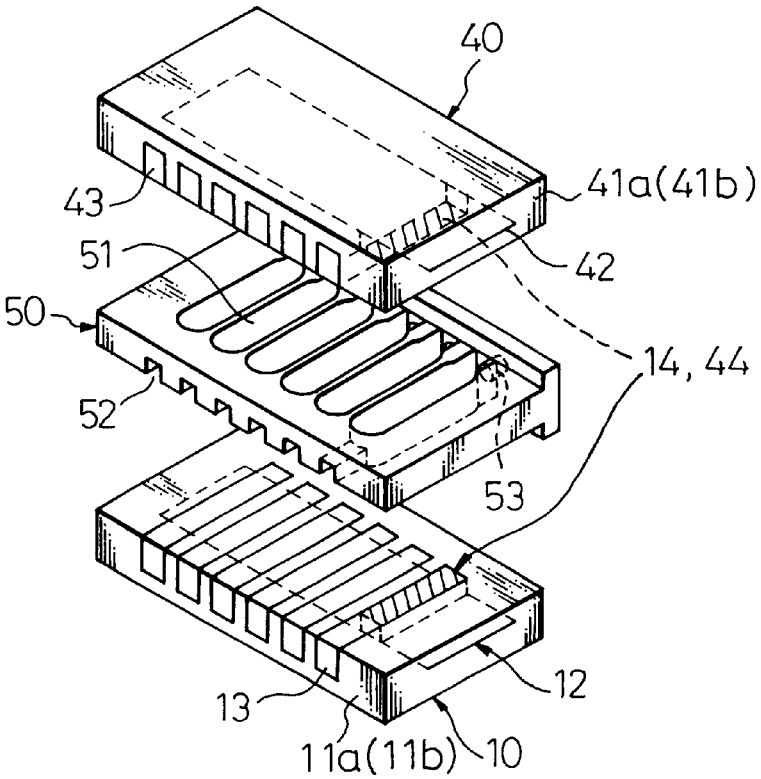
FIGS. 6, 7 and 8 are perspective views of the embodiment similar to those shown in FIGS. 3, 4 and 5, respectively, but having two piezoelectric elements.

FIG. 6 shows an embodiment which is similar to that of FIG. 3, except that there are two piezoelectric elements 10 and 40 and a pressure chamber plate 50 having a plurality of nozzles. The piezoelectric element 40 (the insulating substrate 11*b* and the piezoelectric layer 11*a* are shown as an integral unit) comprises, in the same manner as the piezoelectric element 10 in the embodiment of FIG. 3, a laminated structure of an insulated board 41*b,* a common electrode 42, a piezoelectric layer 41*a* and a plurality of local electrodes 43. The piezoelectric elements 10 and 40 are arranged on each side of the pressure chamber plate 50. Thus, each of the pressure chambers 51 of the pressure chamber plate 50 is opened at the respective surfaces thereof. The respective ink supply ports 52 are provided at one of the ends of the pressure chamber plate 50 and the respective nozzles 53 are provided at the other end thereof. The two piezoelectric elements 10 and 40 and the pressure chamber plate 50 are joined together in such a manner that the portions, i.e., the displacement portions 14 and 44, where the common electrodes 12 and 42 of the piezoelectric elements 10 and 40 cross the local electrodes 13 and 43, respectively, correspond to the respective surfaces of the pressure chambers 51. Ink is filled in the respective pressure chambers 51 through the respective ink supply ports 52 so that air bubbles are not included therein. When an electric voltage is applied between the common electrodes 12 and particular local electrodes 13, only the displacement portions 14 and 44 where the common electrodes 12 and 42 cross the particular local electrodes 13 and 43 are displaced, so that pressure is exerted on the ink in the particular pressure chamber 21 and the ink is ejected from the nozzle 53 in a direction perpendicular to the displacement of the piezoelectric material.

Figure 7:
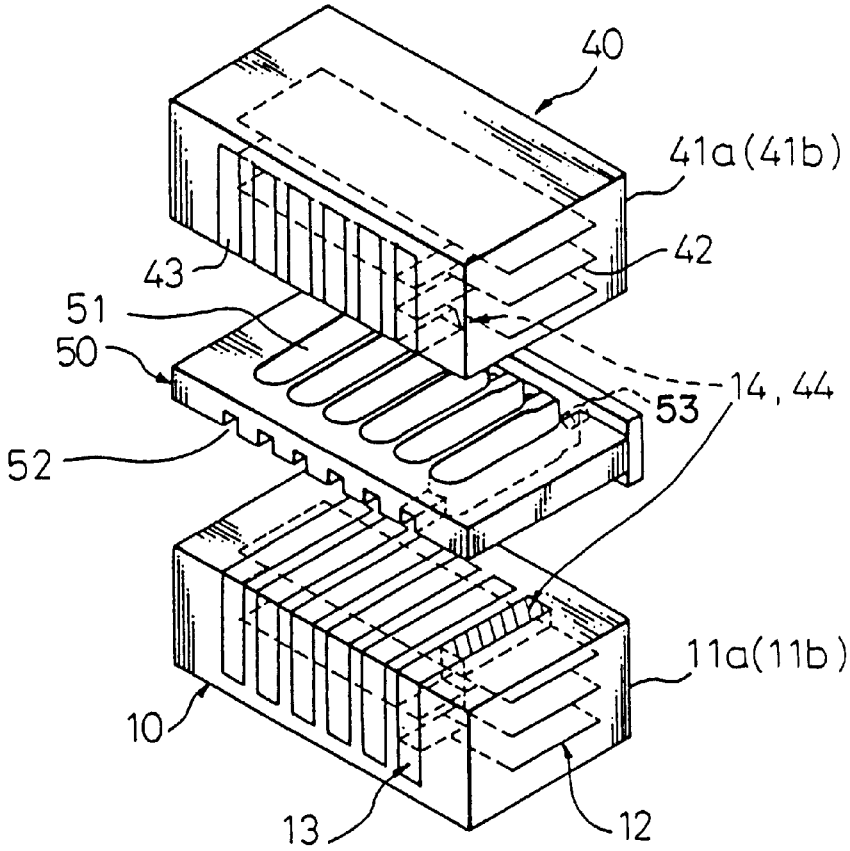

FIG. 7 shows still another embodiment which is similar to that of FIG. 4, except that two multilayer type, i.e., upper and lower, piezoelectric elements 10 and 40 and a pressure chamber plate 50 having a plurality of nozzles are provided. The two piezoelectric elements 10 and 40 are arranged on each side of the pressure chamber plate 50. The pressure chamber plate 50 has a plurality of pressure chambers 51 each opened at the respective sides thereof. The respective ink supply ports 52 are provided at one of the ends of the pressure chamber plate 50 and the respective nozzles 53 are provided at the other ends thereof. The two piezoelectric elements 10 and 40 and the pressure chamber plate 50 are joined together in such a manner that the portions, i.e., the displacement portions 14 and 44, where the common electrodes 12 and 42 of the piezoelectric elements 10 and 40 cross the local electrodes 13 and 43, respectively, correspond to the respective surfaces of the pressure chambers 51. Ink is filled in the respective pressure chambers 51 through the respective ink supply ports 52 so that air bubbles are not included therein. When an electric voltage is applied between the common electrodes 12 and 42 and the particular local electrodes 13 and 43, only the displacement portions 14 and 44 where the common electrodes 12 and 42 crosses the particular local electrode 13 and 43 are displaced, so that pressure is exerted on the ink in the particular pressure chamber 21 and ink is ejected from the nozzle 31.

Figure 8:
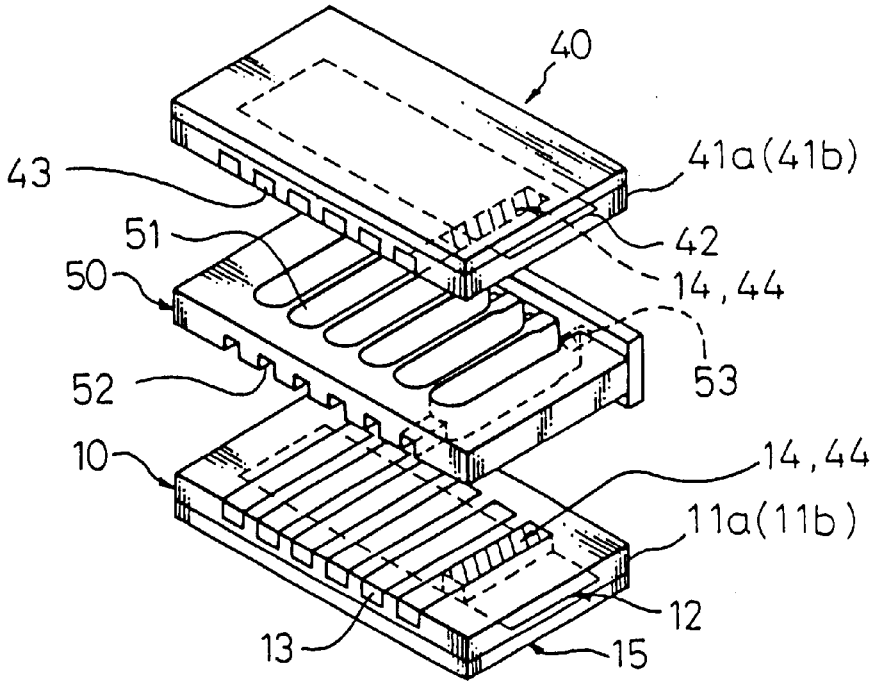

FIG. 8 shows a further embodiment which is similar to that of FIG. 5, except that the upper and lower piezoelectric elements 10 and 40 and a pressure chamber plate 50 having a plurality of nozzles are provided. In the same manner as for the piezoelectric element 10 of the embodiment of FIG. 5, each of the piezoelectric elements 10 and 40 has a metal plate 15 attached onto the outer surface thereof. The piezoelectric elements 10 and 40 are arranged on each side of the pressure chamber 50. A plurality of pressure chambers 51 of the pressure chamber plate 50 are opened at the respective surfaces of the pressure chamber plate 50. The respective ink supply ports 52 are provided at one of the ends of the pressure chamber plate 50 and the respective nozzles 53 are provided at the other ends thereof. The two piezoelectric elements 10 and 40 and the pressure chamber plate 50 are joined together in such a manner that the portions, i.e., the displacement portions, 14 and 44, where the common electrodes 12 and 42 of the piezoelectric elements 10 and 40 cross the local electrodes 13 and 43, respectively, correspond to the respective surfaces of the pressure chamber 51. Ink is filled in the respective pressure chambers 51 through the respective ink supply ports 52 so that air bubbles are not included therein. When an electric voltage is applied between the common electrodes 12 and 42 and the particular local electrodes 13 and 43, only the displacement portions 14 and 44 where the common electrodes 12 and 42 crosses the particular local electrodes 13 and 43 are displaced, so that pressure is exerted on the ink in the particular pressure chamber 21 so that the ink is ejected from the nozzle 53.

Figure 9:
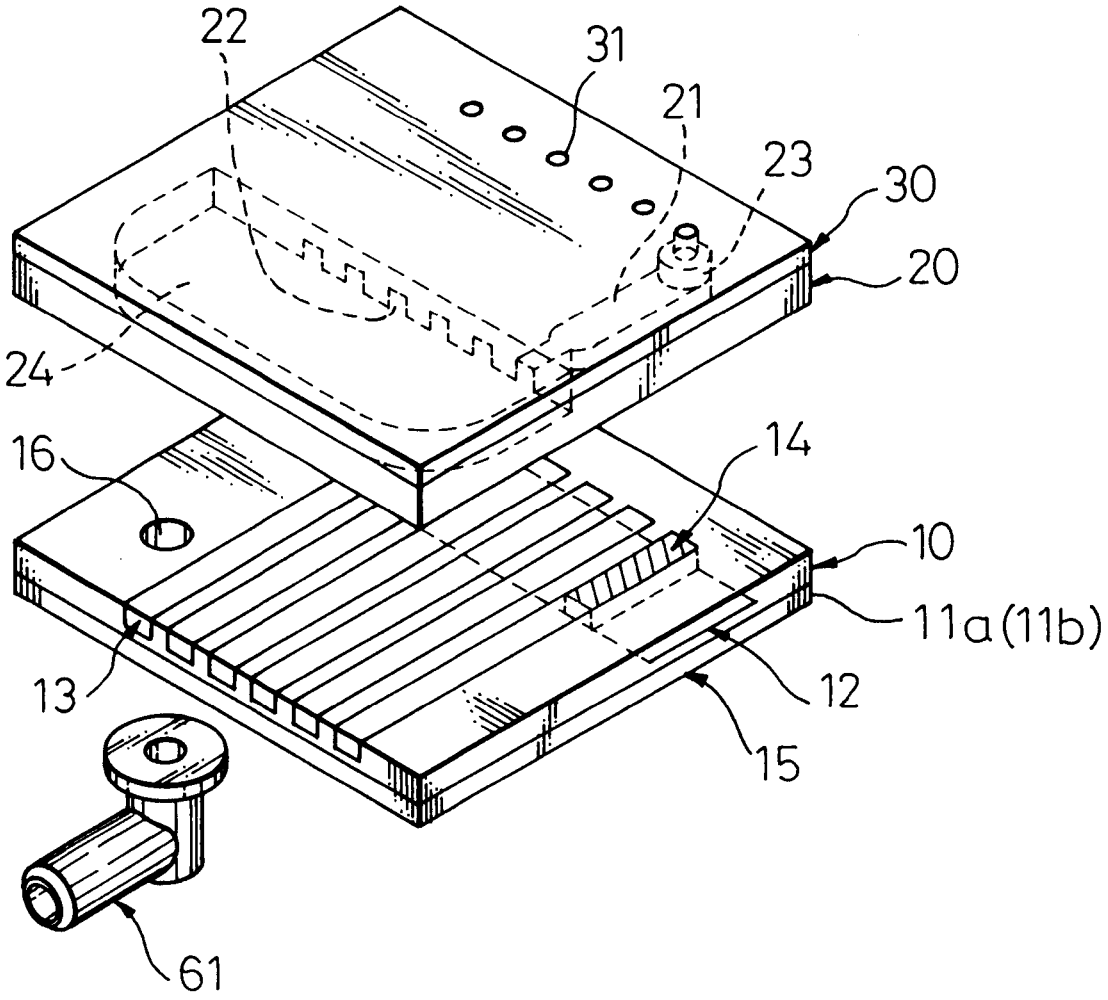
FIG. 9 is a perspective view of a modified embodiment of the ink-jet printing head illustrated in FIG. 5.

FIG. 9 shows a modified embodiment of FIG. 5. The piezoelectric element 10 comprises a plurality of local electrodes 13 formed on a surface thereof facing the pressure chamber plate 20 and a metal plate 15 attached onto the opposite surface of the piezoelectric element 10. A main ink supply port 16 is provided at a position where neither local electrodes nor common electrode are provided. The pressure chamber plate 20 is provided with a plurality of pressure chambers 21 opened at one of the surfaces of this pressure chamber plate 20 and corresponding to the respective local electrodes 13. In addition, the pressure chamber plate 20 is provided with a common ink chamber 24 which opened at the respective surfaces thereof and connected to the respective pressure chambers 21 through the respective ink supply ports 22.

The piezoelectric element 10 and the pressure chamber plate 20 are joined together in such a manner that the portions, i.e., the displacement portions, where the common electrode 12 of the piezoelectric element 10 cross the local electrodes 13, correspond to the respective pressure chambers 21. Thus, the ink chamber 24 of the pressure chamber plate 20 is sealingly closed between the piezoelectric element 10 and the nozzle plate 30 and connected to the main ink inlet port 16. An ink supply member 61 is connected to the opposite side of the main ink inlet port 16.

Ink is always supplied to the-ink chamber 24 through the ink supply member 61 and the main ink supply port 16. Ink is further filled in the respective ink pressure chambers 21 through the respective ink supply ports 22 so that air bubbles are not included therein. When an electric voltage is applied between the common electrode 12 and particular local electrode 13, only the displacement portion 14 where the common electrode 12 crosses the particular local electrode 13 is displaced, so that pressure is exerted on the ink in the particular pressure chamber 21 and the ink is ejected through the ink outlet port 23 and from the nozzle 31.

Figure 10:
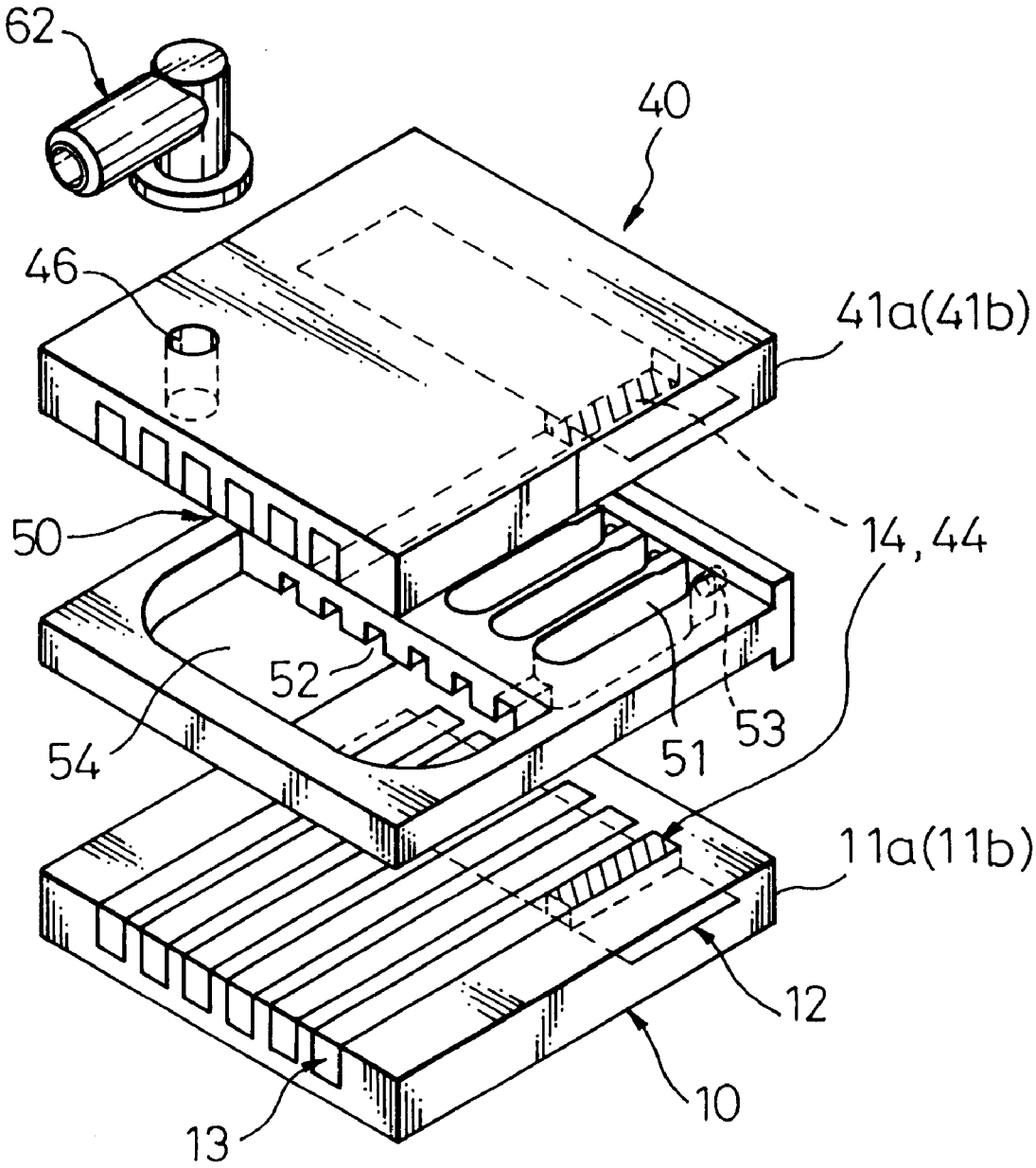
FIG. 10 is a perspective view of an embodiment of the ink-jet printing head similar to that of FIG. 9, but having two piezoelectric elements.

FIG. 10 shows a modified embodiment which is similar to that of FIG. 9, except that the upper and lower piezoelectric elements 10 and 40 and a pressure chamber plate 50 having a plurality of nozzles are provided. In the same manner as the embodiment of FIG. 9, each of the piezoelectric elements 10 and 40 has a metal plate 15 (not shown) attached onto the outer surface thereof. The piezoelectric element 40 is provided with a main ink inlet port 46 extending in the thickness direction thereof and at a position where no electrodes are formed.

The pressure chamber plate 50 is provided with a plurality of pressure chambers 51 opened at the respective surfaces thereof and corresponding to the respective local electrodes 13. In addition, the pressure chamber plate 50 is provided with a common ink chamber 54 which is opened at the respective surfaces thereof and connected to the respective pressure chambers 21 through the respective ink supply ports 52. The piezoelectric elements 10 and 40 are arranged on each side of the pressure chamber plate 50, in such a manner that the portions, i.e., the displacement portions 14 and 44, where the common electrodes 12 and 42 of the piezoelectric elements 10 and 40 cross the local electrodes 13 and 43, respectively, correspond to the upper and lower surfaces of the respective pressure chambers 51, respectively.

Ink is always supplied to the ink chamber 54 through the ink inlet member 62 and the ink supply port 46. Ink is further filled in the respective ink pressure chambers 51 through the respective ink supply ports 52 so that, when an electric voltage is applied between the common electrodes 12 and 42 and particular local electrodes 13 and 43, only the displacement portions 14 and 44 where the common electrodes cross the particular local electrodes are displaced, so that pressure is exerted on the ink in the particular pressure chamber 51 and the ink is ejected from the nozzle 53.

Figure 11:
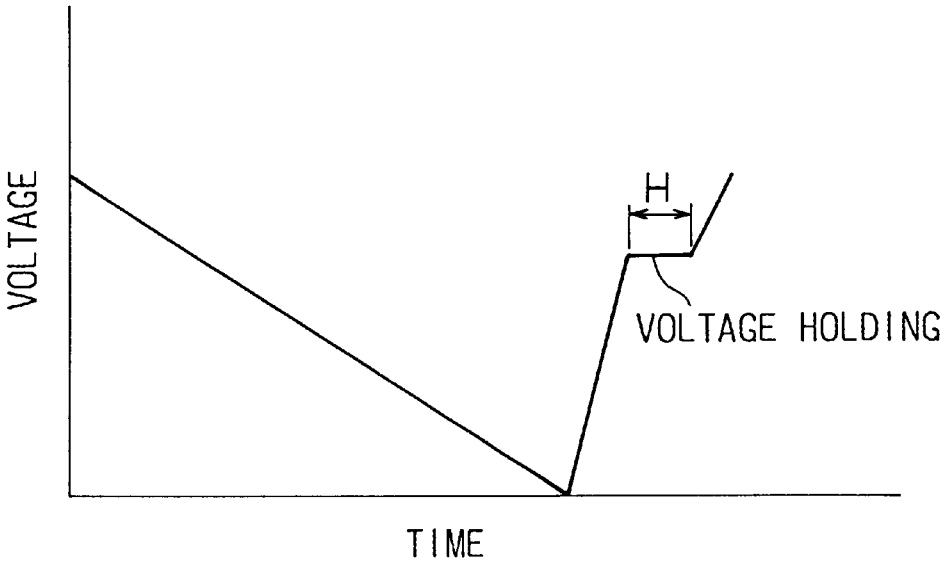
FIG. 11 is a graph showing a driving wave shape of the ink-jet printing head.

FIG. 11 shows a voltage wave shape for driving the ink jet head in the above-mentioned embodiments. When an electric voltage is applied between the common and local electrodes to inject the ink from the nozzle, the voltage is first reduced and then increased abruptly but halfway the voltage is held at a certain value for a short time H. Thus, an unfavorable vibration exerted on the ink is restricted, the particles of ink will become finer and the damping of the ink jet can be reduced after the ink is injected. Thus, the frequency characteristic is improved and a stable ink jet operation can be attained.

Figure 12A:
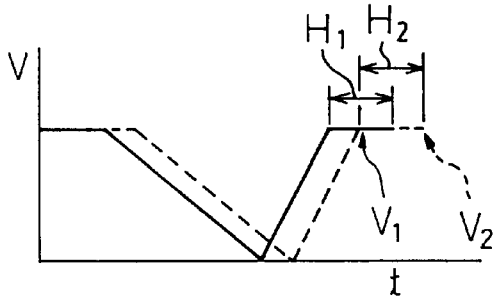
FIGS. 12(*a*) and 12(*b*) are graphs showing driving wave shapes of the ink-jet printing head having two piezoelectric elements.
Figure 12B:
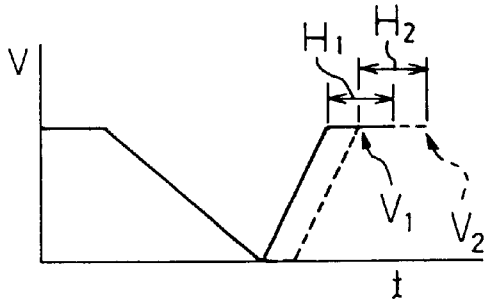

FIGS. 12(*a*) and 12(*b*) are graphs showing a voltage wave shape for driving the ink-jet printing head having two piezoelectric elements in the embodiments shown in FIGS. 2, 6, 7, 8 and 10. The timing of voltage $V_1$ applied between the common and local electrodes in one of the piezoelectric elements is shifted by a certain time from the timing of voltage $V_2$ applied between the common and local electrodes of the other piezoelectric element. Thus, the particles of ink will become finer and the damping of the ink jet can be reduced after the ink is injected. Thus, a frequency characteristic can be improved and a stable ink jet operation can be attained. In the respective voltage wave shapes $V_1$ and $V_2$, the voltage holding time H1, H2 can be provided in the same manner as FIG. 11. In FIG. 12(*a*), the timing is shifted for both during voltage reduction and increase. However, in FIG. 12(*b*), the timing is only shifted during the voltage increase.

Figure 13:
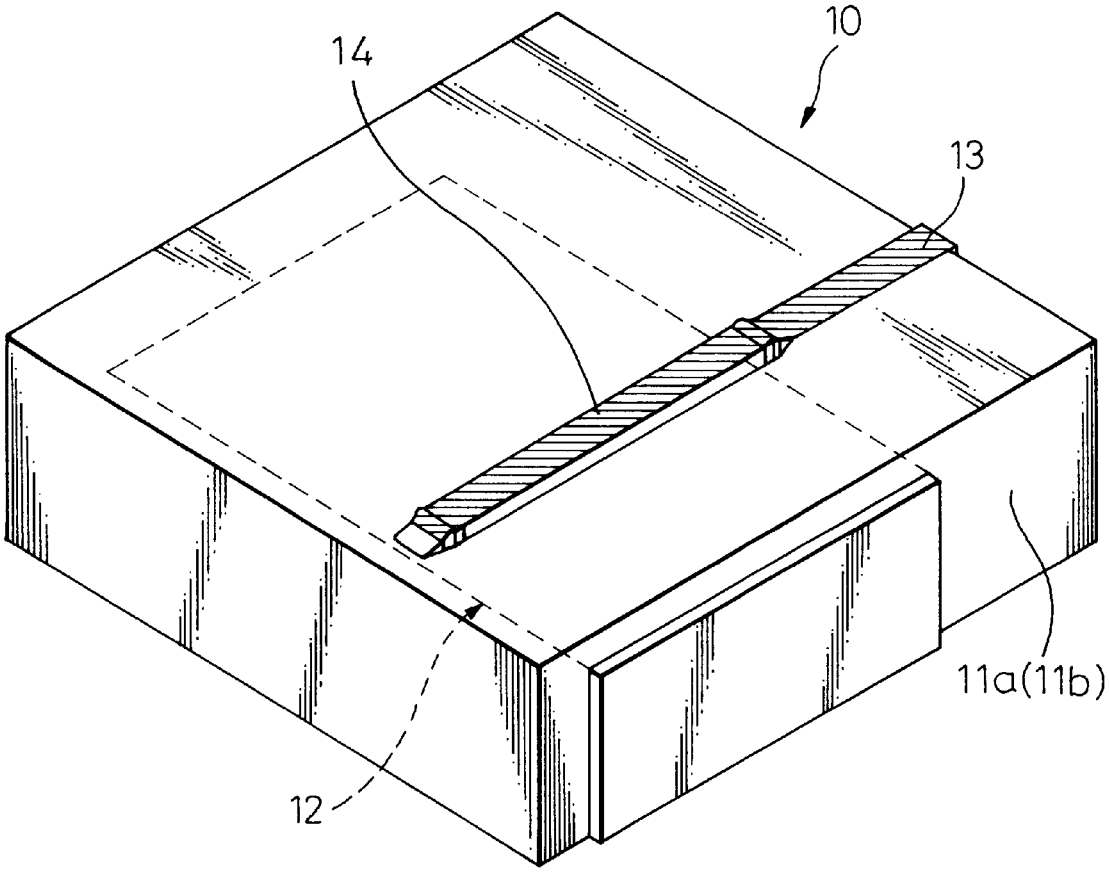
FIG. 13 shows exaggeratedly a state of the displacement portion of the piezoelectric element, where a local electrode crosses a common electrode, when an electric voltage is applied thereacross.

FIG. 13 schematically and exaggeratedly shows a state of the displacement portion 14 of the piezoelectric element 10 when an electric current is applied between the common electrode 12 and the local electrode 13. When an electric voltage is applied, between a relatively wide and longitudinally extending inner or common electrode 13 and a plurality of thin and transversely extending local electrodes (only one is illustrated in FIG. 13) arranged on the upper surface of the piezoelectric material 11 and spaced in parallel by a certain distance from the common electrode, the portion, i.e., the displacement portion 14, where these electrodes cross to each other, is displaced upwardly, as shown in this drawing. In particular, the displacement portion 14 significantly displaces at the respective ends thereof. Due to such raising up of the displacement portion 14, a pressure is exerted to the pressure chamber, as described above. As the piezoelectric material, PNN series, PMN series, PZN series, PZT series or the like materials can be utilized. On the other hand, as the material of the electrodes, a conductive paste, such as of gold, silver, silver palladium or the like, can appropriately be used. As the material of the pressure chamber plate 20 or 50, a resin, such as polyimide, polyethylene nitride (PEN), polysulfone or the like, a metal, such as stainless steel, aluminum or the like, or ceramic can appropriately be used.

Figure 14A:
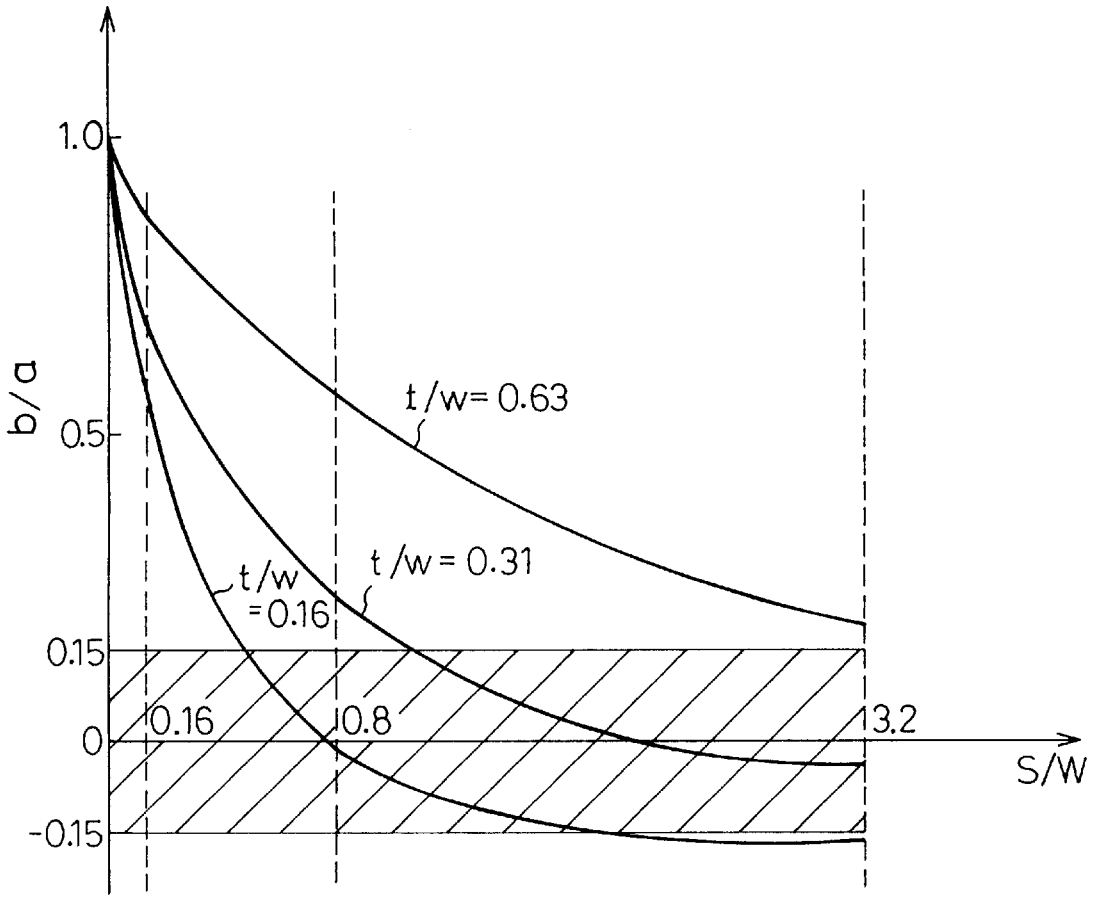
FIGS. 14(*a*), 14(*b*) and 14(*c*) illustrate the relationship of the gap (t) between the local and common electrodes, the width (w) of the local electrode, and the distance (s) between the adjacent local electrodes.
Figure 14B:
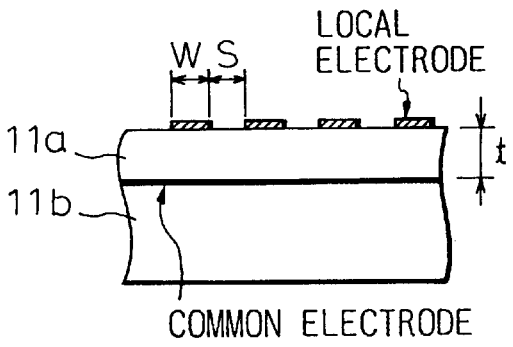
Figure 14C:
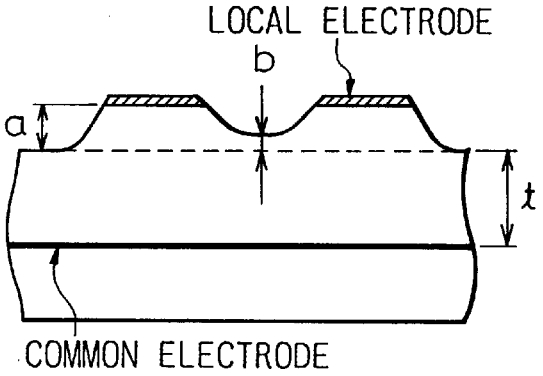

FIGS. 14(*a*), 14(*b*) and 14(*c*) illustrate the relationship of the gap between the local and common electrodes, the width (w) of the local electrode, and the distance (s) between the adjacent local electrodes. First, as shown in FIG. 14(*b*), "t" indicates a distance in the thickness direction through piezoelectric material between the common and local electrodes when no voltage is applied, "w" indicates a width of the strip-like local electrode, "s" indicates a gap between the adjacent local electrodes and "w+s" indicates an arrangement pitch of the local electrodes. In FIG. 14(*a*), the abscissa represents s/w and the ordinate represents b/a. Here, a: a maximum displacement in the thickness direction at the portion of the local electrode, as shown in FIG. 14(*c*); and b: a maximum displacement in the thickness direction at the portion between the adjacent local electrodes, as shown in FIG. 14(*c*).

In order to reduce the variation in the speed and volume of the particles of ink to the practical level, it is desired that b/a should be reduced to the value less than 15% of the maximum electrode displacement, i.e., the portion indicated by hatching in FIG. 14(*a*). When s/w becomes larger, if $t/w<0.15$, as the portion out of the hatching, the displacement of the element is excessive in the minus direction. Therefore, if two or more local electrodes spaced from each other (for example, two electrodes adjacent but one) are driven, the portion of the piezoelectric material in the area between these local electrodes will become unstable and, therefore, it becomes impossible to use. Therefore, it is necessary that $t/w \geqq 0.15$. If $s/w<0.5$, the displacement of the element in the area between the electrodes is so large that it becomes impossible to use. In view of the above, it is necessary that $t/w \geqq 0.15$ and $s/w \geqq 0.5$. Even in a piezoelectric element of any other material, as mentioned above, the displacement is similar and therefore the relationship of t, w and s as shown in FIG. 14(*a*) can also be applied.

It should be understood by those skilled in the art that the foregoing description relates to only a preferred embodiment of the disclosed invention, and that various changes and modifications may be made to the invention without departing from the spirit and scope thereof.

We claim:

1. A piezoelectric type ink-jet printing head comprising:

a pressure chamber plate at least partially defining a pressure chamber;

means for supplying ink into said pressure chamber;

a nozzle connected to said pressure chamber; and a piezoelectric element having a surface, at least a part thereof defining a displacement portion;

said pressure chamber plate being attached to said surface of the piezoelectric element in such a manner that said displacement portion of the piezoelectric element defines at least one wall of said pressure chamber;

wherein said pressure chamber plate is less flexible than said piezoelectric element, said pressure chamber plate has a plurality of pressure chambers including said pressure chamber, said piezoelectric element comprises a common electrode, a plurality of local electrodes and a piezoelectric material arranged between said common electrode and said local electrodes, and areas where said local electrodes cross said common electrode define a plurality of displacement portions, including said displacement portion, respectively corresponding to said pressure chambers, and said common electrode and said plurality of local electrodes are arranged so as to satisfy the following representation: $t/w \geqq 0.15$ and $s/w \geqq 0.5$;

where "t" is a distance through the piezoelectric material between the common electrode and said plurality of local electrodes, "w" is a width of a local electrode of said plurality of local electrodes, and "s" is a distance between two adjacent local electrodes of said plurality of local electrodes.

2. A piezoelectric type ink-jet printing head of claim 1, wherein said pressure chamber plate is integrally formed of a single material.

3. A piezoelectric type ink-jet printing head of claim 1, wherein said pressure chamber plate includes first and second surfaces, substantially parallel, and separated by a distance substantially smaller than a length of said pressure chamber plate, said length of said pressure chamber plate being in a direction parallel to said first and second surfaces of said pressure chamber plate.

4. The piezoelectric type ink-jet printing head of claim 1, wherein said pressure chamber plate is rigid.

5. The piezoelectric type ink-jet printing head of claim 1 wherein said surface of said piezoelectric element is planar.

6. A piezoelectric type ink-jet printing head as set forth in claim 1, wherein said piezoelectric element comprises a laminated structure made of a plurality of layers, in which said common electrode and said plurality of local electrodes are alternately laminated with the piezoelectric material therebetween, and said plurality of local electrodes of respective layers are arranged to respectively correspond to each of said plurality of pressure chambers and are electrically connected to each other, through said laminated structure.

7. A piezoelectric type ink-jet printing head as set forth in claim 1, wherein said piezoelectric material of said piezoelectric element includes a first surface and a second surface;

said plurality of local electrodes are arranged on said first surface of said piezoelectric material of said piezoelectric element so as to be spaced from said common electrode of said piezoelectric element; and said piezoelectric element includes a metal plate attached to said second surface of said piezoelectric material of said piezoelectric element.

8. A piezoelectric type ink-jet printing head as set forth in claim 1, further comprising voltage applying means for selectively applying an electric voltage between said common electrode and said plurality of local electrodes of said piezoelectric element during at least one voltage holding time.

9. A piezoelectric type ink-jet printing head as set forth in claim 1, wherein said piezoelectric material comprises a material selected from the group consisting of:

PNN series $\{Pb(Ni_{1/3}Nb_{2/3})O_3—PbTiO_3\}$, PMN series $\{Pb(Mg_{1/3}Nb_{2/3})O_3—PbTiO_3\}$, PZN series $\{Pb(Zn_{1/3}Nb_{2/3})O_3—PbTiO_3\}$, and PZT series $\{PbTiO_3—PbZrO_3\}$ materials.

10. A piezoelectric type ink-jet printing head comprising:

a pressure chamber plate having first and second surfaces and at least partially defining a pressure chamber opened at said first and second surfaces;

means for supplying ink into said pressure chamber;

a nozzle connected to said pressure chamber; and first and second piezoelectric elements each having a surface, at least a part of each surface of said first and second piezoelectric elements respectively defining first and second displacement portions;

said first and second piezoelectric elements being attached to said first and second surfaces of the pressure chamber plate, respectively, in such a manner that said first and second displacement portions of the first and second piezoelectric elements define two opposed, first and second walls of said pressure chamber, wherein said pressure chamber plate is less flexible than said first and second piezoelectric elements, said pressure chamber plate at least partially defines a plurality of pressure chambers including said pressure chamber, and each of said first and second piezoelectric elements comprises a common electrode, a plurality of local electrodes and a piezoelectric material arranged between said common electrode and said plurality of local electrodes, and areas where said local electrodes cross said common electrode define a plurality of displacement portions, including said first and second displacement portions, respectively defining two opposed walls for each of said plurality of pressure chambers, including said first and second walls.

11. A piezoelectric type ink-jet printing head as set forth in claim 10, wherein a voltage source is connected to said first and second piezoelectric elements to energize said first and second piezoelectric elements with voltages having respective driving pulses, timing of the driving pulses being shifted with respect to each other.

12. A piezoelectric type ink-jet printing head as set forth in claim 10, wherein at least one of said first and second piezoelectric elements comprises a laminated structure made of a plurality of layers, in which said common electrode and said plurality of local electrodes are alternately laminated with the piezoelectric material therebetween, and said plurality of local electrodes of respective layers are arranged to respectively correspond to each of said plurality of pressure chambers and are electrically connected to each other through said laminated structure.

13. A piezoelectric type ink-jet printing head as set forth in claim 10, wherein said piezoelectric material of at least one of said first and second piezoelectric elements includes a first surface and a second surface said plurality of local electrodes are arranged on said first surface of said piezoelectric material of said at least one of said first and second piezoelectric elements so as to be spaced from said common electrode of said at least one of said first and second piezoelectric elements; and said at least one of said first and second piezoelectric elements includes a metal plate attached to said second surface of said piezoelectric material of said at least one of said first and second piezoelectric elements.

14. A piezoelectric type ink-jet printing head as set forth in claim 10, further comprising voltage applying means for selectively applying an electric voltage between said common electrode and said plurality of local electrodes of respective ones of said first and second piezoelectric elements during at least one voltage holding time.

15. A piezoelectric type ink-jet printing head of claim 10, wherein said pressure chamber plate is integrally formed of a single material.

16. A piezoelectric type ink-jet printing head of claim 10, wherein said first and second surfaces of said pressure chamber plate are substantially parallel and separated by a distance substantially smaller than a length of said pressure chamber plate, said length of said pressure chamber plate being in a direction parallel to said first and second surfaces of said pressure chamber plate.

17. The piezoelectric type ink-jet printing head of claim 10, wherein said pressure chamber plate is rigid.

18. The piezoelectric type ink-jet printing head of claim 10 wherein each surface of said first and second piezoelectric elements are planar.

19. A piezoelectric type ink-jet printing head as set forth in claim 10, wherein said piezoelectric material comprises a material selected from the group consisting of:

PNN series $\{Pb(Ni_{1/3}Nb_{2/3})O_3—PbTiO_3\}$, PMN series $\{Pb(Mg_{1/3}Nb_{2/3})O_3—PbTiO_3\}$, PZN series $\{Pb(Zn_{1/3}Nb_{2/3})O_3—PbTiO_3\}$, and PZT series $\{PbTiO_3—PbZrO_3\}$ materials.

20. A piezoelectric type ink-jet printing head comprising:

a pressure chamber plate having first and second surfaces, a plurality of pressure chambers opened at said first and second surfaces, a plurality of ink supply ports for respectively supplying ink into said plurality of pressure chambers, and a plurality of nozzles respectively connected to said plurality of pressure chambers; and first and second piezoelectric elements each having a surface, at least parts thereof defining a plurality of displacement portions;

said first and second piezoelectric elements being attached to said first and second surfaces of the pressure chamber plate, respectively, in such a manner that said plurality of displacement portions of said first and second piezoelectric elements respectively define two opposed, first and second walls of each of said plurality of pressure chambers, wherein said pressure chamber plate is less flexible than said first and second piezoelectric elements, and each of said first and second piezoelectric elements comprises a common electrode, a plurality of local electrodes and a piezoelectric material arranged between said common electrode and said plurality of local electrodes, and areas where said local electrodes cross said common electrode define said plurality of displacement portions.

21. A piezoelectric type ink-jet printing head of claim 20, wherein said pressure chamber plate is integrally formed of a single material.

22. A piezoelectric type ink-jet printing head of claim 20, wherein said first and second surfaces of said pressure chamber plate are substantially parallel and separated by a distance substantially smaller than a length of said pressure chamber plate, said length of said pressure chamber plate being in a direction parallel to said first and second surfaces of said pressure chamber plate.

23. The piezoelectric type ink-jet printing head of claim 20, wherein said pressure chamber plate is rigid.

24. The piezoelectric type ink-jet printing head of claim 20 wherein each surface of said first and second piezoelectric elements are planar.

25. A piezoelectric type ink-jet printing head as set forth in claim 20, wherein a voltage source is connected to said first and second piezoelectric elements to energize said first and second piezoelectric elements with voltages having respective driving pulses, timing of the driving pulses being shifted with respect to each other.

26. A piezoelectric type ink-jet printing head as set forth in claim 20, wherein at least one of said first and second piezoelectric elements comprises a laminated structure made of a plurality of layers, in which said common electrode and said plurality of local electrodes are alternately laminated with the piezoelectric material therebetween, and said plurality of local electrodes of respective layers are arranged to respectively correspond to each of said plurality of pressure chambers and are electrically connected to each other through said laminated structure.

27. A piezoelectric type ink-jet printing head as set forth in claim 20, wherein said piezoelectric material of at least one of said first and second piezoelectric elements includes a first surface and a second surface;

said plurality of local electrodes are arranged on said first surface of said piezoelectric material of said at least one of said first and second piezoelectric elements so as to be spaced from said common electrode of said at least one of said first and second piezoelectric elements; and said at least one of said first and second piezoelectric elements includes a metal plate attached to said second surface of said piezoelectric material of said at least one of said first and second piezoelectric elements.

28. A piezoelectric type ink-jet printing head as set forth in claim 20, further comprising voltage applying means for selectively applying an electric voltage between said common electrode and said plurality of local electrodes of respective ones of said first and second piezoelectric elements during at least one voltage holding time.

29. A piezoelectric type ink-jet printing head as set forth in claim 20, wherein said common electrode and said plurality of local electrodes are arranged so as to satisfy the following representation: $t/w \geqq 0.15$ and $s/w \geqq 0.5$;

where "t" is a distance through the piezoelectric material between the common electrode and said plurality of local electrodes, "w" is a width of a local electrode of said plurality of local electrodes, and "s" is a distance between two adjacent local electrodes of said plurality of local electrodes.

30. A piezoelectric type ink-jet printing head as set forth in claim 20, wherein said piezoelectric material comprises a material selected from the group consisting of:

PNN series $\{Pb(Ni_{1/3}Nb_{2/3})O_3—PbTiO_3\}$, PMN series $\{Pb(Mg_{1/3}Nb_{2/3})O_3—PbTiO_3\}$, PZN series $\{Pb(Zn_{1/3}Nb_{2/3})O_3—PbTiO_3\}$, and PZT series $\{PbTiO_3—PbZrO_3\}$ materials.

31. A piezoelectric type ink-jet printing head comprising:

a pressure chamber plate at least partially defining a pressure chamber;

means for supplying ink into said pressure chamber;

a nozzle connected to said pressure chamber; and a piezoelectric element having a surface, at least a part thereof defining a displacement portion;

said pressure chamber plate being attached to said surface of the piezoelectric element in such a manner that said displacement portion of the piezoelectric element defines at least one wall of said pressure chamber;

wherein said pressure chamber plate is less flexible than said piezoelectric element, said pressure chamber plate has a plurality of pressure chambers including said pressure chamber, and said piezoelectric element comprises a common electrode, a plurality of local electrodes and a piezoelectric material arranged between said common electrode and said local electrodes, and areas where said local electrodes cross said common electrode define a plurality of displacement portions, including said displacement portion, respectively corresponding to said pressure chambers.

32. A piezoelectric type ink-jet printing head of claim 31, wherein said pressure chamber plate is integrally formed of a single material.

33. A piezoelectric type ink-jet printing head of claim 31, wherein said first surface and said second surface of said pressure chamber plate are substantially parallel and separated by a distance substantially smaller than a length of said pressure chamber plate, said length of said pressure chamber plate being in a direction parallel to said first surface and said second surface of said pressure chamber plate.

34. The piezoelectric type ink-jet printing head of claim 31, wherein said pressure chamber plate is rigid.

35. The piezoelectric type ink-jet printing head of claim 31 wherein said surface of said piezoelectric element is planar.

36. A piezoelectric type ink-jet printing head as set forth in claim 31, wherein said piezoelectric element comprises a laminated structure made of a plurality of layers, in which said common electrode and said plurality of local electrodes are alternately laminated with the piezoelectric material therebetween, and said plurality of local electrodes of respective layers are arranged to respectively correspond to each of said plurality of pressure chambers and are electrically connected to each other through said laminated structure.

37. A piezoelectric type ink-jet printing head as set forth in claim 31, wherein said piezoelectric material of said piezoelectric element includes a first surface and a second surface;

said plurality of local electrodes are arranged on said first surface of said piezoelectric material of said piezoelectric element so as to be spaced from said common electrode of said piezoelectric element; and said piezoelectric element includes a metal plate attached to said second surface of said piezoelectric material of said piezoelectric element.

38. A piezoelectric type ink-jet printing head as set forth in claim 31, further comprising voltage applying means for selectively applying an electric voltage between said common electrode and said plurality of local electrodes of said piezoelectric element during at least one voltage holding time.

39. A piezoelectric type ink-jet printing head as set forth in claim 31, wherein said common electrode and said plurality of local electrodes are arranged so as to satisfy the following representation: $t/w \geqq 0.15$ and $s/w \geqq 0.5$;

where "t" is a distance through the piezoelectric material between the common electrode and said plurality of local electrodes, "w" is a width of a local electrode of said plurality of local electrodes, and "s" is a distance between two adjacent local electrodes of said plurality of local electrodes.

40. A piezoelectric type ink-jet printing head as set forth in claim 31, wherein said piezoelectric material comprises a material selected from the group consisting of:

PNN series $\{Pb(Ni_{1/3}Nb_{2/3})O_3—PbTiO_3\}$, PMN series $\{Pb(Mg_{1/3}Nb_{2/3})O_3—PbTiO_3\}$, PZN series $\{Pb(Zn_{1/3}Nb_{2/3})O_3—PbTiO_3\}$, and PZT series $\{PbTiO_3—PbZrO_3\}$ materials.

41. A piezoelectric type ink-jet printing head comprising:

a pressure chamber plate having first and second surfaces and at least partially defining a pressure chamber opened at said first and second surfaces;

means for supplying ink into said pressure chamber;

a nozzle connected to said pressure chamber; and first and second piezoelectric elements each having a surface, at least a part of each surface of said first and second piezoelectric elements respectively defining first and second displacement portions;

said first and second piezoelectric elements being attached to said first and second surfaces of the pressure chamber plate, respectively, in such a manner that said first and second displacement portions of the first and second piezoelectric elements define two opposed, first and second walls of said pressure chamber, wherein said pressure chamber plate is less flexible than said first and second piezoelectric elements, said pressure chamber plate at least partially defines a plurality of pressure chambers including said pressure chamber, each of said first and second piezoelectric elements comprises a common electrode, a plurality of local electrodes and a piezoelectric material arranged between said common electrode and said plurality of local electrodes, and areas where said local electrodes cross said common electrode define a plurality of displacement portions, including said first and second displacement portions, respectively defining two opposed walls for each of said plurality of pressure chambers, including said first and second walls, and said common electrode and said plurality of local electrodes are arranged so as to satisfy the following representation: $t/w \geqq 0.15$ and $s/w \geqq 0.5$;

where "t" is a distance through the piezoelectric material between the common electrode and said plurality of local electrodes, "w" is a width of a local electrode of said plurality of local electrodes, and "s" is a distance between two adjacent local electrodes of said plurality of local electrodes.

* * * * *